United States Patent [19]

Wolf et al.

[11] Patent Number: 4,496,024

[45] Date of Patent: Jan. 29, 1985

[54] SOUND ABSORPTION PANEL AND METHOD OF MAKING

[75] Inventors: Jerry M. Wolf, Westerville; Wilbur D. Holben, Ostrander, both of Ohio

[73] Assignee: Midwest-Acoust-A-Fiber, Inc., Ostrander, Ohio

[21] Appl. No.: 526,894

[22] Filed: Aug. 26, 1983

[51] Int. Cl.[3] ..... E04B 1/82

[52] U.S. Cl. ..... 181/292; 181/286; 181/294; 428/116; 156/290; 156/306.6; 156/309.6

[58] Field of Search ..... 181/286, 288, 292, 291, 181/296, 294; 428/116, 117, 118; 156/306.6, 309.6, 290, 295, 325, 197

[56] References Cited

U.S. PATENT DOCUMENTS

| | | | |
|---|---|---|---|
| 3,529,693 | 9/1970 | Woodward et al. | 181/33 |
| 3,700,067 | 10/1972 | Dobbs et al. | 181/33 |
| 3,822,762 | 7/1974 | Crispin et al. | 181/33 |
| 4,249,976 | 2/1981 | Hudson | 428/116 X |
| 4,265,955 | 5/1981 | Harp et al. | 428/116 |
| 4,294,329 | 10/1981 | Rose et al. | 181/222 |
| 4,353,947 | 10/1982 | Northcutt | 428/116 |

FOREIGN PATENT DOCUMENTS

| | | | |
|---|---|---|---|
| 2150511 | 4/1973 | France | 428/116 |

*Primary Examiner*—L. T. Hix
*Assistant Examiner*—Brian W. Brown
*Attorney, Agent, or Firm*—Sidney W. Millard

[57] ABSTRACT

A sound absorption panel in which a honeycomb core exhibiting cell end planes has bonded to those planes a porous fiberglass pelt, a layer of thermoplastic material intermediate the core and the porous fiberglass pelt having been subjected to pressure and heated to the point of liquification providing the bond between the porous fiberglass pelt and the cell end plane of the honeycomb core. The thermoplastic in its melted state penetrates the fibers of the porous fiberglass pelt and flows around the edges of the cell end plane of the honeycomb core.

15 Claims, 3 Drawing Figures

SOUND ABSORPTION PANEL AND METHOD OF MAKING

FIELD OF THE INVENTION

The invention relates to a sound absorption panel and a method for making such a panel.

BACKGROUND OF THE INVENTION

Numerous sound absorption panels have been made utilizing honeycomb expanded type materials as the basic sound absorption medium. A core of honeycomb material is covered by a facing of porous fiberglass and even with plastic sheeting on one or both sides whether such sheeting is decorative or not; these additional materials variously adding to the sound absorption capacities of the resultant panel.

The customary method for securing the porous fiberglass facing to the honeycomb core is by means of glue or other adhesive material, an additional manufacturing step. However, since such adhesive materials do not meet current fire regulations, sound absorption composite panels which utilize adhesive materials to secure a porous fiberglass facing to a honeycomb core may not be utilized in areas where fire codes and regulations must be adhered to. It is noted that the word porous is a term used in the art to refer to a medium that will pass air and in which the acoustical panel utilizes the mechanism of absorption rather than dampening to achieve air borne sound attenuation.

Therefore, there is a need for a sound absorption panel and a method of making such a panel whereby the porous fiberglass facing may be securely attached to a honeycomb core by means other than the use of adhesive materials, in a cost effective and better accoustically performing way.

SUMMARY OF THE INVENTION

This invention provides a method for making a sound absorption panel in which an unprocessed composite sandwich structure is constructed and then subjected to further processing according to this invention as described below. This composite sandwich structure has a honeycomb core with a porous fiberglass facing pelt placed over at least one of the sides of the core on which the honeycomb cell ends are exposed (i.e., cell end plane). A thermoplastic sheet is placed intermediate the fiberglass pelt and the cell end plane of the honeycomb core, the dimensions of the cell end place of the honeycomb core, the porous fiberglass pelt and the thermoplastic sheet being coextensive with one another. This composite sandwich structure is placed between the surfaces of a platen press which then compresses the sandwich structure, thereafter sufficient heat is provided so that the thermoplastic sheet will melt providing a secure bond between the porous fiberglass pelt and the cell end surface of the honeycomb. It has been found that satisfactory thermoplastic materials include polyethylene, polypropylene, polyvinylchloride and polyvinylacetate.

The resulting product of the foregoing method is a sound absorption panel in which a honeycomb core has a porous fiberglass pelt securely bonded to at least one of the cell end planes of the honeycomb core, and the porous fiberglass pelt and melted thermoplastic has been partially pressed into the cells of the honeycomb.

BRIEF DESCRIPTION OF THE DRAWINGS

The best mode contemplated in carrying out this invention is illustrated and better understood by reference to the following detailed description when considered together with the accompanying drawings, in which.

DESCRIPTION OF THE PREFERRED EMBODIMENT

Figure 1:
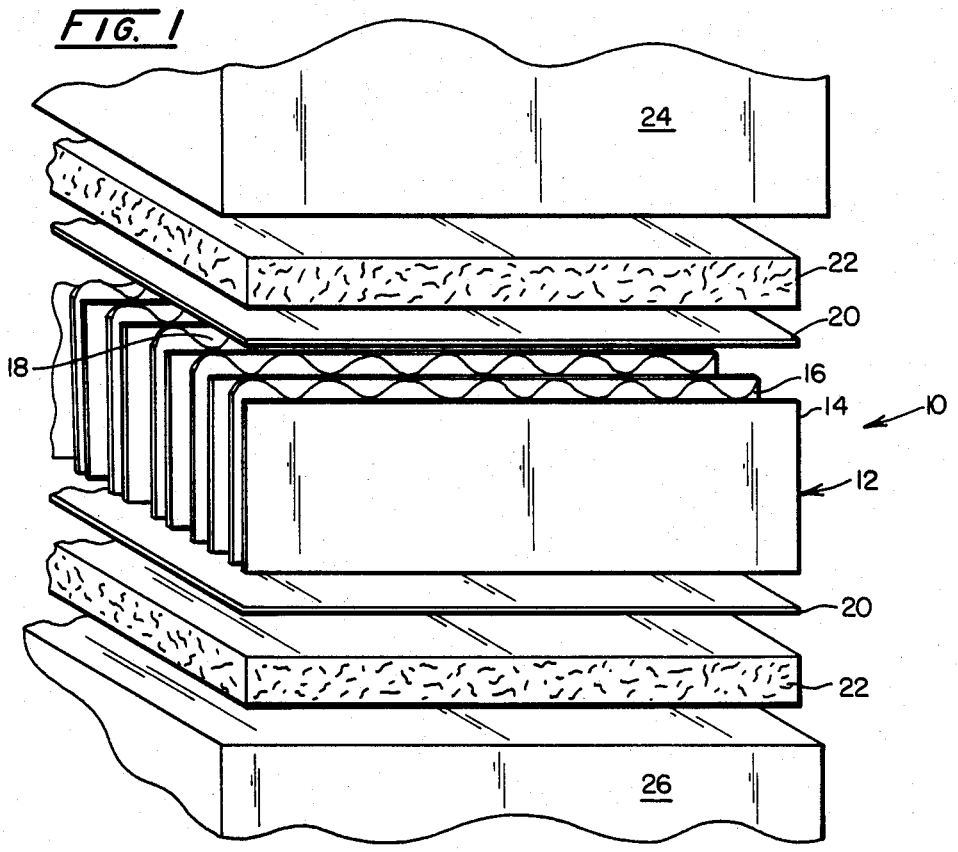
FIG. 1 is an exploded view of structural sandwich in platen press for making a sound absorption panel according to the present invention
Figure 2:
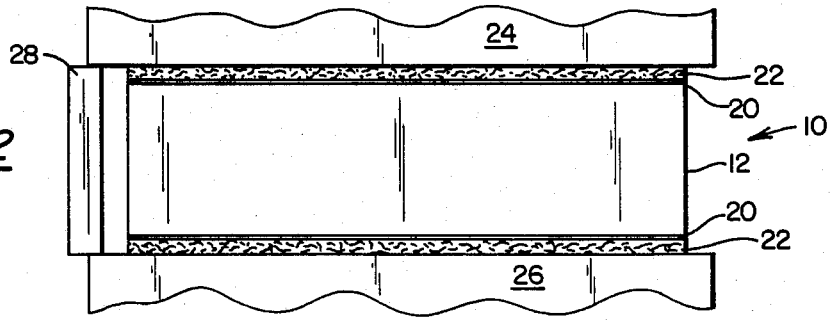
FIG. 2 shows a structural sandwich in platen press according to method of present invention.

With reference to the drawings, FIGS. 1 and 2 illustrate the steps by which a composite structural sandwich 10 is constructed and subjected to further processing The structural sandwich 10 comprises a honeycomb core 12 which is of the conventional type, preferably a cardboard and paper expanded honeycomb structure approximately 1 to 1½ inches (25.4 to 38.1 mm) in cell height. The honeycomb core 12 is built up from cardboard support members 14 and a corrugated paper 16 glued to the cardboard support members 14. The edges of the corrugated paper 16 and the edges of cardboard support member 14 produce a cell end plane 18 in which the honeycomb cells are terminated in an open fashion. Typically, a honeycomb core 12 will have at least two such cell end planes. A bonding layer in the form of a thermoplastic sheet 20, preferably polypropylene in the thickness range ½ to 4 mil (0.013 to 0.102 mm), is placed over the cell end plane 18 of the honeycomb core 12. The structural sandwich 10 concludes with what is known in the art as a porous fiberglass pelt 22 which is placed over the thermoplastic 20. The fiberglass pelt has an initial thickness of 1 inch (25.4 mm) and has a pre-compression density of about 0.75 to 2.5 lbs. per cubic foot (12.1 to 40.3 kg/cubic meter) and a compressed density of about 6 to about 18 lbs. per cubic foot (96.34 to 289.0 kg/cubic meter) and preferably has a phenolic resin content of 16–25 percent by weight in order that upon compression the compressed porous fiberglass pelt will retain permanently its compressed state. The demensions of the cell end plane 18, the thermoplastic sheet 20, and the porous fiberglass pelt 22 are such that they are coextensive with one another.

It will be appreciated that since there is more than one cell end plane 18 associated with the honeycomb core portion of a structural sandwich, additional pieces of thermoplastic sheet 20 and for each such thermoplastic sheet a corresponding porous fiberglass pelt 22 may be placed adjacent the other cell end plane thereby producing a structural sandwich that is symmetrical about the center line of the honeycomb core 12. Additionally, it will be appreciated that other plastics as for example polyethylene, polyvinylchloride or polyvinylacetate may be substituted for the polypropylene sheet 20.

The structural sandwich 10, assembled according to this invention, is placed between the upper surface 24 and lower surface 26 of a simple platen press, as shown in FIG. 2; and the structural sandwich 10 compressed to a predetermined thickness, the entire amount of compression taking place in the porous fiberglass pelts and not in the honeycomb core. The porous fiberglass pelts are reduced in thickness, and to a small extent pressed into the open cell ends of the cell end plane 18 of the honeycomb core 12. Heat is then applied, preferably through the platen surfaces or by other dry means, to the compressed structural sandwich 10. The heat level should be sufficient to melt the thermoplastic sheet 20 sufficiently for the liquified thermoplastic sheet 20 to penetrate the immediately adjacent fibers of the porous fiberglass pelt 22 and additionally flow over and form a secure bond to the paper and cardboard edges of cell end plane 18 of the honeycomb core. A temperature of 450° F. (232° C.) applied for a period of 1.5 to 3.5 minutes has been found to be satisfactory to complete the bonding process.

The structural sandwich 10 is shown in FIG. 2 in the compressed state, the upper surface 24 and lower surface 16 of the platen press being retained at a fixed distance from one another by a mechanical stop 28, preferably a metal block. It is necessary to maintain the platen press surfaces at a fixed distance from one another so that there is not too much compression of the sandwich structure such that the honeycomb core 12 might be structurally damaged and so that the porous fiberglass pelt is not crushed beyond the desired density amounts. Additionally, it is desirable to control the final dimension of the sound absorption panel so that panels of consistent thickness may be produced time after time. A total compressed thickness of the structural sandwich is preferred to be 2 inches (50.8 mm), a 1-1¾ inch (44.5 mm) core and two 1 inch (25.4 mm) uncompressed porous fiberglass pelts are utilized.

Figure 3:
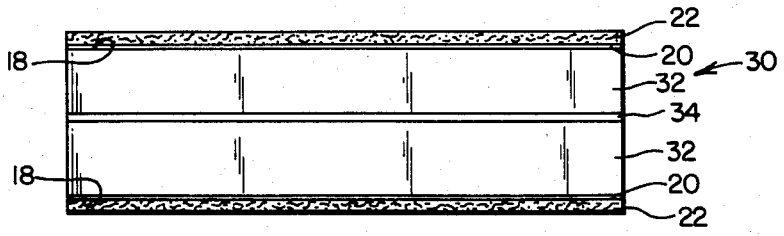
FIG. 3 is an elevational view of an alternative embodiment of the sound absorption panel according to the present invention.

In FIG. 3 there is illustrated a sound absorption panel according to the present invention which utilizes a modified honeycomb core 30. The honeycomb core 30 has two layers of cardboard and paper cellular honeycomb 32, which may or may not be identical to each other, separated by a structural divider 34, preferably a heavy cardboard material thereby producing two independent tiers of honeycomb material each of which has a single cell end plane 18 against which a thermoplastic sheet 20 followed by a porous fiberglass pelt 22 may be placed, compressed and heated for appropriate bonding.

It will be apparent from the above description that this invention provides a method of making a sound absorption panel having a honeycomb core with the cell end plane thereof bonded to a porous fiberglass facing or pelt at one or both of the available cell end planes. This bonding is accomplished by a sheet of thermoplastic material being placed between the cell end surface of the honeycomb core and the porous fiberglass facing; and the porous fiberglass pelt, thermoplastic sheet, honeycomb core structural sandwich being subjected to heat and pressure such that the plastic melts, penetrating the immediate fiberglass fibers and flowing around the ends of the honeycomb cells at the cell end plane.

Having thus described this invention, what is claimed is:

1. A method of making a sound absorption panel comprising, assembling a substantially planar sandwich structure of two fiberglass pelts, two non-porous thermoplastic sheets and a paper honeycomb core in the sequence pelt-sheet-core-sheet-pelt;

said assembled pelts each having a density in the range of about twelve to about forty $Kg/m^3$ and incorporating about sixteen to about twenty-five percent by weight of phenolic resin; said assembled sheets being selected from the group consisting of polypropylene, polyethylene, polyvinylchloride, and polyvinylacetate and having a thickness in the range of about 0.013 mm to about 0.102 mm and the assembled honeycomb structure having a thickness in the range of about twenty-five to thirty-eight mm and with the cells of the honeycomb oriented perpendicular to the plane of the sheets;

arranging the pelts, sheets and core to have substantially coextensive peripheries and between a pair of planar presses, moving the presses toward each other to compress the pelts to no more than about one-fourth their original thickness without compressing the core, stopping the movement of the presses by means unrelated to the resistance force of the sandwich structure, heating the presses to a temperature of about 450° F. for a period of about one and one-half to about three and one-half minutes to (1) cause the phenolic resin to hold the fibers of the pelts in the compressed condition and (2) melt the thermoplastic and thereby allow passage of gases from the cells of the honeycomb through the pelts;

cooling the sandwich to freeze the melted thermoplastic and thereby bond the pelts to the core.

2. The method according to claim 1 wherein said thermoplastic sheet is polypropylene.

3. The method according to claim 1 wherein said thermoplastic sheet is polyvinylchloride.

4. The method according to claim 1 wherein said thermoplastic sheet is polyethylene.

5. The method according to claim 1 wherein said thermoplastic sheet is polyvinylacetate.

6. The method according to claim 1 wherein said platen press has mechanical stops such that the sandwich structure will be compressed to a uniform thickness.

7. The method according to claim 1 wherein said honeycomb core has at least two independent cell tiers.

8. The product made by the process of claim 1.

9. A sound absorption panel comprising a paper honeycomb core having a plurality of cell walls defining cells and first and second cell end planes, and a compressed porous fiberglass pelt bonded to at least one of said cell end planes by melted thermoplastic wherein the thermoplastic has penetrated the fibers of said fiberglass pelt and flowed around the edges of said cell walls, said core and pelt having the physical property of allowing gas to pass through the pelt into the cells of the core, said pelt including about sixteen to about twenty-five percent by weight of phenolic resin binder and having a density in the range of about 96 to about 289 $Kg/m^3$, said thermoplastic being selected from the group consisting of polypropylene, polyethylene, polyvinylchloride, and polyvinylacetate.

10. A sound absorption panel according to claim 9 wherein said fiberglass pelt is about 1 to about 2 pounds per cubic foot in density before it is compressed and bonded to said honeycomb core.

11. A sound absorption panel according to claim 9 wherein said thermoplastic sheet is polypropylene.

12. A sound absorption panel according to claim 9 wherein said thermoplastic sheet is polyvinylchloride.

13. A sound absorption panel according to claim 9 wherein said thermoplastic sheet is polyethylene.

14. A sound absorption panel according to claim 9 wherein said thermoplastic sheet is polyvinylacetate.

15. A sound absorption panel according to claim 9 wherein said honeycomb core has at least two independent cell tiers.

* * * * *